US006740010B2

(12) United States Patent
Sze

(10) Patent No.: US 6,740,010 B2
(45) Date of Patent: May 25, 2004

(54) MOTORIZED STATIONARY BIKE FOR LOWER BODY REHABILITATION

(75) Inventor: Yar Hung Sze, Yulin Region (TW)

(73) Assignee: Alex Wu, Mississauga (CA)

( * ) Notice: Subject to any disclaimer, the term of this patent is extended or adjusted under 35 U.S.C. 154(b) by 10 days.

(21) Appl. No.: 10/163,469

(22) Filed: Jun. 7, 2002

(65) Prior Publication Data

US 2003/0050152 A1 Mar. 13, 2003

(51) Int. Cl.[7] ..... A63B 23/04; A61H 1/00
(52) U.S. Cl. ..... 482/63; 482/4; 601/34
(58) Field of Search ..... 482/57–65, 51, 482/4–7; 601/36, 34, 35

(56) References Cited

U.S. PATENT DOCUMENTS 4,592,544 A 6/1986 Smith et al.
4,790,528 A 12/1988 Nakao et al.
5,033,736 A * 7/1991 Hirschfeld ..... 601/36
5,549,527 A 8/1996 Yu
5,584,783 A 12/1996 Hagg
5,807,211 A 9/1998 Berryhill
5,971,894 A 10/1999 Chen
6,220,991 B1 * 4/2001 Sellers ..... 482/62
6,270,445 B1 * 8/2001 Dean et al. ..... 482/4

* cited by examiner

*Primary Examiner*—Stephen R. Crow
(74) *Attorney, Agent, or Firm*—Marks & Clerk (Canada)

(57) ABSTRACT

A motorized stationary bike is provided for lower body rehabilitation. The motorized stationary bike has the same general appearance as an ordinary bike. Furthermore, it comprises a motor, a drive shaft, a coupler, a worm gear, and a toothed gear where the motor, the drive shaft, the coupler, and the worm gear are axially aligned one to another, and are horizontally disposed on the bike frame. The motor is connected to the drive shaft, and the drive shaft is coupled to the worm gear by the coupler. The worm gear is engaged to the toothed gear. The motor is coupled to an electrical energy source such that when the motor is turned on, the worm gear drives the toothed gear, which causes each of the step pedal supporting arms and the respective step pedal to turn.

4 Claims, 6 Drawing Sheets

MOTORIZED STATIONARY BIKE FOR LOWER BODY REHABILITATION

FIELD OF THE INVENTION

This invention relates to a motorized stationary bike, and particularly relates to a motorized stationary bike for lower body rehabilitation. The motorized stationary bike of the present invention has the same general appearance as an ordinary stationary bike; however the motor and the gears of the motorized stationary bike of the present invention are arranged in such a manner that frictional damage caused by the moving components is significantly reduced in comparison with an ordinary stationary rehabilitation bike.

BACKGROUND OF THE INVENTION

The use of stationary bikes has, of course, been known for many years. Their purpose is to strengthen the muscles of the legs and the waist of the exerciser, without having the exerciser to perform the exercise outdoors.

Very often, outdoor activity such as biking, is not feasible under the harsh weather and heavy traffic conditions. Thus, many people are restricted to performing exercises indoors. Various stationary bikes have been developed and provided on the market for indoor use, where the stationary bike simulates the riding of a bicycle.

It has been known for many years in the medical and athletic communities that biking is an excellent form of exercise to strengthen the muscles of the legs and the waist. Thus, biking has been a highly recommended form of exercise for many patients. However, many geriatric or wheelchair bound patients, who are recovering from illness by surgical operations or patients who have been weakened by being confined to bed with a disease, are too weak to be biking outdoors. Nevertheless, lower body rehabilitation is most important for these patients. Stationary bike, which allows patient to simulate the riding of a bicycle indoors, has been the exercising device used.

Unfortunately, the stationary bikes which are provided on the market are targeted for those people who wish to keep physically fit without having to venture outdoors. These stationary bikes are not particularly designed for people who need rehabilitation. Indeed, many of the existing stationary bikes consist of bicycle cranks which are driven by the feet of the exerciser, and a load means which provides resistance to the pedal motion, thereby providing the exerciser with a force to work against. The resistance provided by these existing stationary bikes is considerably too strenuous for people who are being rehabilitated to restore the muscles of the legs and the waist.

The present inventor herein has provided a motorized stationary bike which is designed in such a manner that once the motor is turned on, the gears will cause the step pedals to turn in a synchronized motion, thus inducing leg movements of the exerciser. Furthermore, the motorized stationary bike provided by the present inventor is such that the motor and the gears of the motorized stationary bike are arranged in a manner that frictional damage caused by the various moving components of the motorized stationary bike is significantly reduced in comparison with an ordinary stationary bike.

The motorized stationary bike of the present invention generally comprises a bike frame, a pair of step pedals, a pair of step pedal supporting arms, a seat, and a seat supporting arm, a handlebar mounting frame, a motor, a drive shaft, a coupler, a worm gear, and a toothed gear. The motor, the drive shaft, the coupler, and the worm gear are axially aligned one to another, and they are all horizontally disposed on the bike frame. The motor is connected to the drive shaft which is coupled to the worm gear by the coupler. Furthermore, the worm gear is engaged to the toothed gear, which has a centrally disposed shaft, and that the shaft is horizontally and outwardly extends at both sides of the toothed gear. The toothed gear and the motor each has an axis, and the axes are arranged in such a manner that the axis of the toothed gear is located in a plane which is perpendicular to the plane in which the axis of the motor is located. In the motorized stationary bike of the present invention, the motor is coupled to an electrical energy source. Thus, when the motor is turned on, the worm gear drives the toothed gear, which causes each of the step pedal supporting arms and the respective step pedal to turn. Here, the exerciser does not have to overcome a resistance in each of the pedal motions since the load means is essentially eliminated in the motorized stationary bike of the present invention. To that end, the user may concentrate on lower body rehabilitation, without over exerting the muscles of the legs, and the waist.

DESCRIPTION OF THE PRIOR ART

Several typical prior art stationary bikes are now described. They include YU U.S. Pat. No. 5,549,527, issued Aug. 27, 1996, which teaches an exercise bike having the seat and the handlebar mounted frame turned about a pivot means on a stand and supported on a link means. The transmission gear box is connected to the stand by pivot means such that the seat and handlebar mounting frame is alternatively oscillated up and down when the crank and pedal assembly is pedaled to drive the transmission gear box.

U.S. Pat. No. 4,790,528 issued December 13 to Nakao et al. teaches a training device and method. A target heart rate is entered into the device, the heart rate is then measured, and accordingly a load in an ergometer operated by the person undergoing rehabilitation is changed. The training device has at least four training steps, warming-up, automatic control, interval and cool-down.

In another U.S. Pat. No. 5,971,894 issued Oct. 26, 1999, the inventor CHEN has provided an exercising bicycle including a supporting base, a movable base slidably and adjustably secured to the supporting base, at least one pivot bar pivotally connected with the supporting base, a supporting bar pivotally connected with the movable base and to the pivot bar, a seat mounted on the pivot bar, a transmission case having pedal members movably mounted thereto, and a resistance device for providing resistance to movement of the pedal members. The stationary bike provided by CHEN is designed for people who wish to keep physically fit; it is not suitable for people who are physically weak in the lower body and are in need of rehabilitation.

U.S. Pat. No. 5,584,783 issued Dec. 17, 1996 to HAGG et al. teaches a strength exercise apparatus for use with stationary bicycles. The apparatus allows the user to exercise the upper body while utilizing a stationary bicycle. It includes a cord which is slidably and adjustably secured to a longitudinal rail at any location intermediate the ends of the longitudinal rail. Thus, while pedaling and/or supported on the stationary bicycle, the user can exercise his upper body by stretching the cords extending at various angles from locations in front, behind, and vertically below the user and with the desired tension depending upon the length of the cords relative to the rails.

U.S. Pat. No. 5,807,211 issued Sep. 15, 1998 to BERRY-HILL teaches an exercise device adaptable for use by physically weak and debilitated individuals. In particular, the exercise device is designed to be used by individuals while seated in a stationary chair. The inventive exercise device employs a folding frame to which are attached bicycle type pedals, a leg press bar, and resistance pulls. When the front of the exercise device is positioned in front of an individual seated in a chair, pedaling exercises can be accomplished. When the rear of the exercise device is positioned in front of a seated individual, exercises utilizing the leg press and resistance pulls can be accomplished.

Finally, SMITH et al. U.S. Pat. No. 4,592,544 issued Jun. 3, 1986 teaches a pedal-operated, exercise device. The exercise apparatus includes a base and a flywheel mounted on the base for rotation about a vertical axis. The flywheel is coupled in driven relationship to a pair of pedal cranks mounted on the base. The pedal cranks are mounted for rotation about a horizontal axis as in a conventional bicycle. In a preferred embodiment, the flywheel is mounted directly below the pedals on a shaft whose upper end is formed to be a worm, the worm being driven by a drive gear attached to the pedal cranks. Since the exercise apparatus is pedal-operated, the exercise provided is much too strenuous for people who are undergoing rehabilitation.

SUMMARY OF THE INVENTION

In accordance with one aspect of the present invention, there is provided a motorized stationary bike for lower body rehabilitation.

The motorized stationary bike of the present invention comprises a bike frame having first and second ends, a pair of step pedals, a pair of step pedal supporting arms in which each of them has first and second ends, a seat, a seat supporting arm having first and second ends, a handlebar mounting frame, a motor, a drive shaft, a coupler, a worm gear, and a toothed gear.

The motor, the drive shaft, the coupler, and the worm gear are axially aligned one to another, and are horizontally disposed on the bike frame.

The motor is connected to the drive shaft, and the drive shaft is coupled to the worm gear by a coupler. Furthermore, the worm gear is engaged to a toothed gear.

The toothed gear has a centrally disposed shaft, and the shaft horizontally and outwardly extends at both sides of the toothed gear.

In keeping with the present invention, the second end of each of the step pedal supporting arms is connected to the shaft, in the region of each of the sides of the toothed gear, such that each of the step pedal supporting arms extends in an opposed direction one to the other. Moreover, the first end of each of the step pedal supporting arms has a step pedal pivotally attached thereto.

The first end of the seat supporting arm has a seat attached thereto, while the second end of the seat supporting arm is mounted on the bike frame, in the region of the second end of the bike frame thereof.

The handlebar mounting frame is situated on the bike frame, in the region of the first end of the bike frame thereof.

The toothed gear and motor each has an axis, and the axis of the toothed gear is located in a plane which is perpendicular to the plane in which the axis of the motor is located.

Still further, the motor is coupled to an electrical energy source such that when the motor is turned on, the worm gear drives the toothed gear, which causes each of the step pedal supporting arms and the respective step pedal to turn.

Typically, the motorized stationary bike of the present invention comprises a fan which is connected to the motor at an end remote from the drive shaft.

In a particular embodiment, the motorized stationary bike of the present invention may further comprises a transmission case which is mounted on the bike frame, in the region between the first and second ends of the bike frame. The transmission case houses the motor, the drive shaft, the coupler, the worm gear, the toothed gear, the shaft and the fan therein.

The seat supporting arm has two portions in which the two portions are telescopically fitted one over the other so as to permit the adjustment of the seat on the seat supporting arm.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
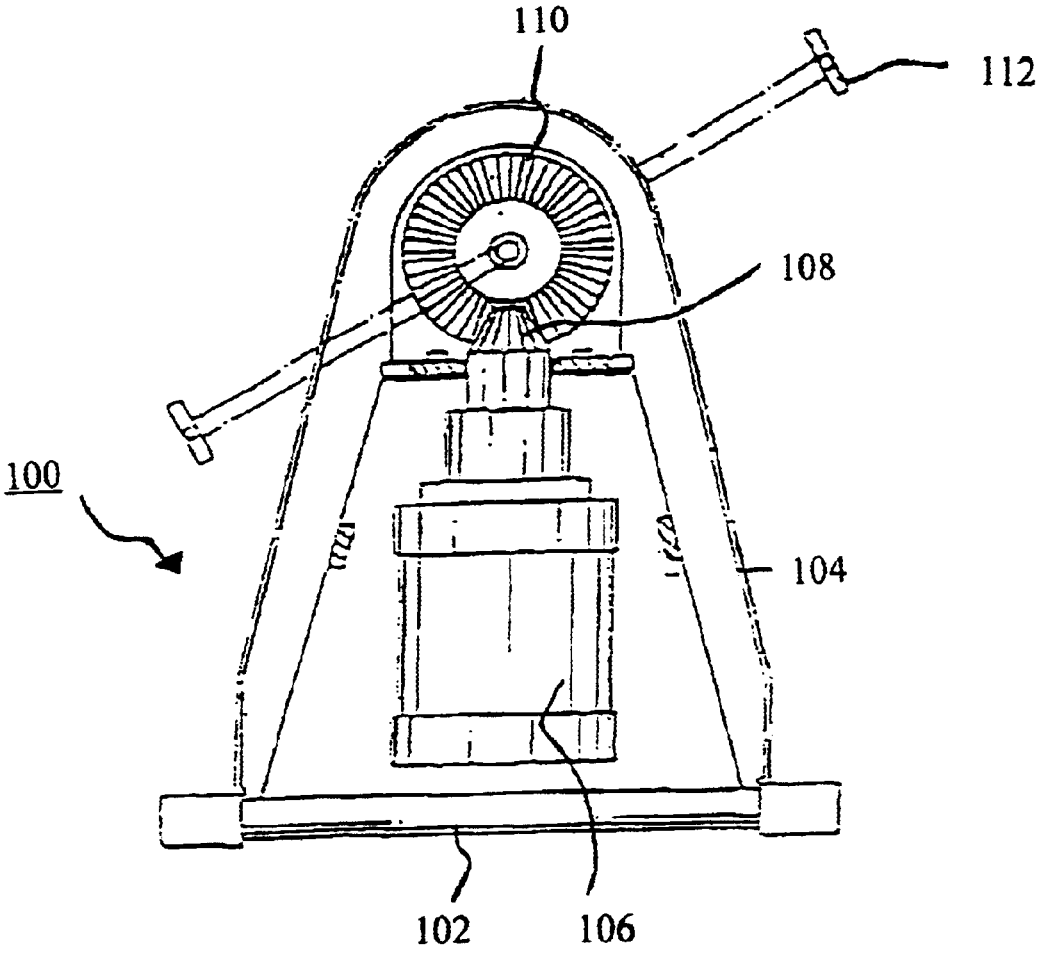
Prior Art Figure 1
FIG. 1 is a side view of a rehabilitation stationary bike according to the prior art.

A lower portion of a typical stationary bike provided in the prior art is shown in FIG. 1. The stationary bike 100 comprises a supporting base 102, and a frame cover 104 which houses a motor 106. In this particular stationary bike 100, the two bevelled gears 108 and 110 are geared together to the motor 106 and the step pedals 112. Because of the arrangement of the two bevelled gears, they are easily damaged.

As noted above, a feature of the present invention is essentially to provide a motorized stationary bike for lower body rehabilitation. The motorized stationary bike of the present invention has the same general appearance as an ordinary stationary bike; however the motor and the gears of the motorized stationary bike of the present invention are arranged in such a manner that frictional damage caused by the moving components is significantly reduced in comparison with an ordinary stationary rehabilitation bike.

Figure 2:
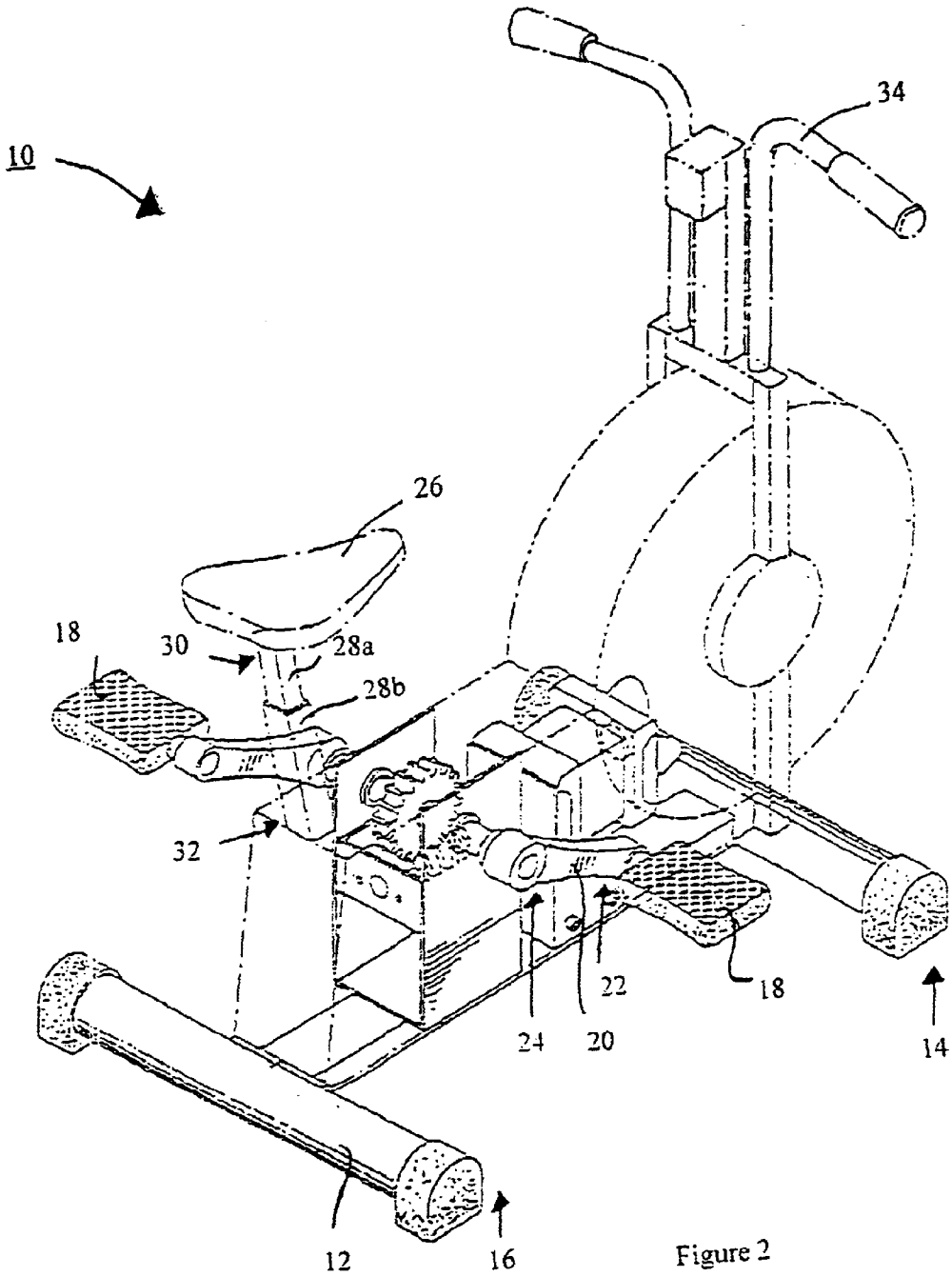
FIG. 2 is a perspective view of the motorized stationary bike of the present invention.

With reference to FIG. 2, a perspective view of the motorized stationary bike 10 of the present invention is shown. The motorized stationary bike 10 of the present invention comprises a bike frame 12 having first and second ends 14 and 16 respectively, a pair of step pedals 18, a pair of step pedal supporting arms 20, each having first and second ends 22 and 24 respectively, a seat 26, and a seat supporting arm 28 which has first and second ends 30 and 32, and a handlebar mounting frame 34.

Figure 3:
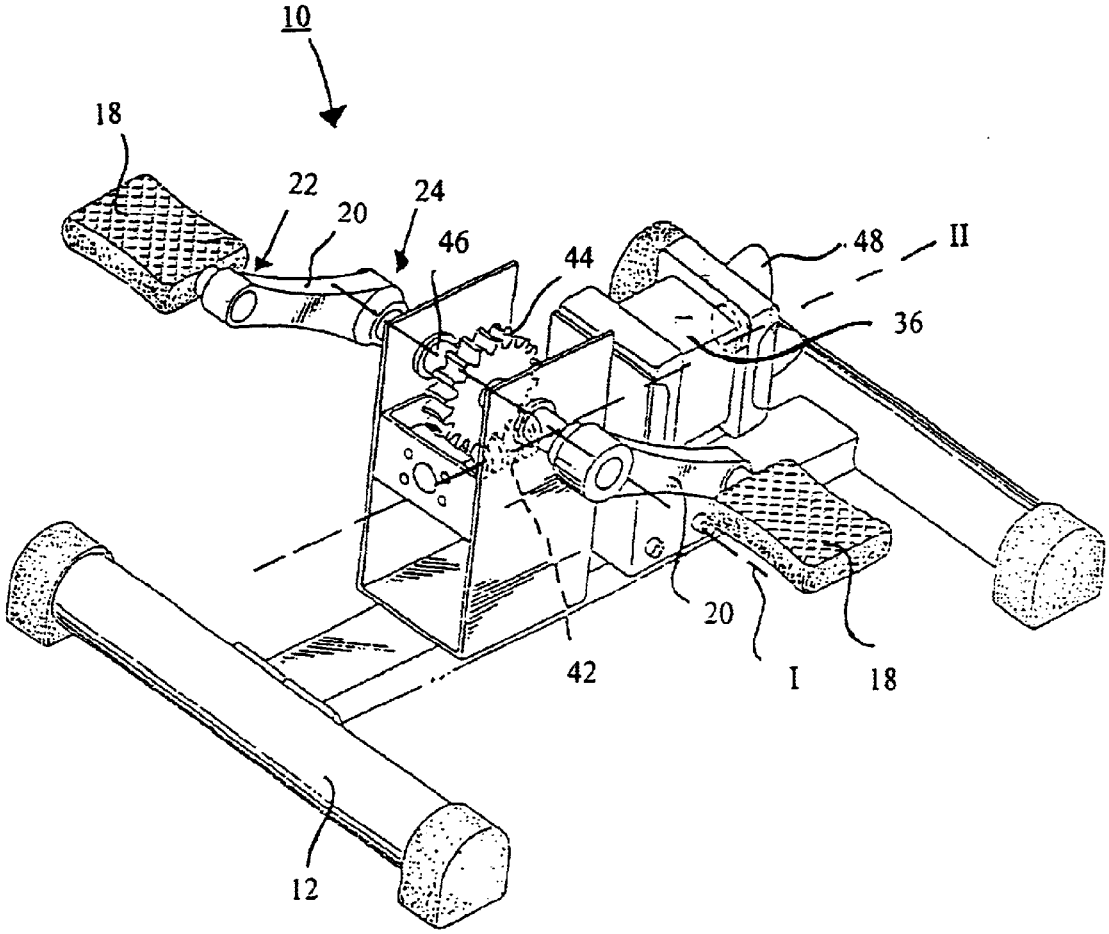
FIG. 3 is a perspective view of the lower portion of the motorized stationary bike of the present invention, with the transmission case removed to show the moving components of the motorized stationary bike.
Figure 4:
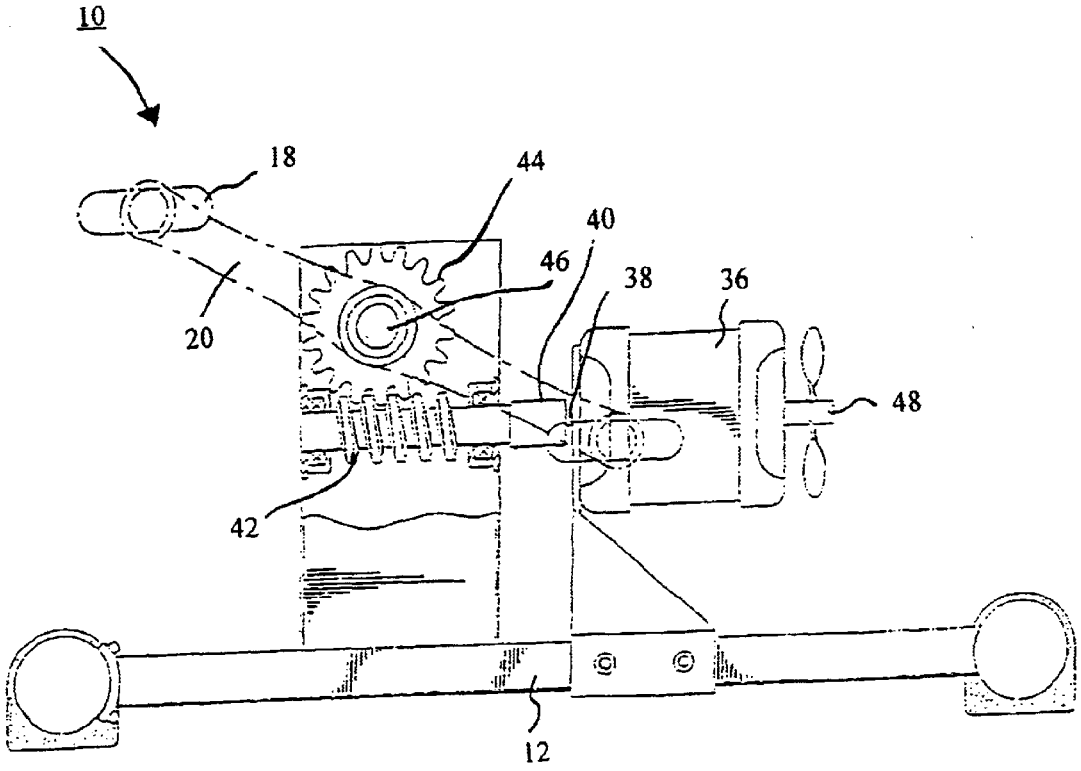
FIG. 4 is a side view of the lower portion of the motorized stationary bike of the present invention, with the transmission case removed to show the moving components of the motorized stationary bike.
Figure 5:
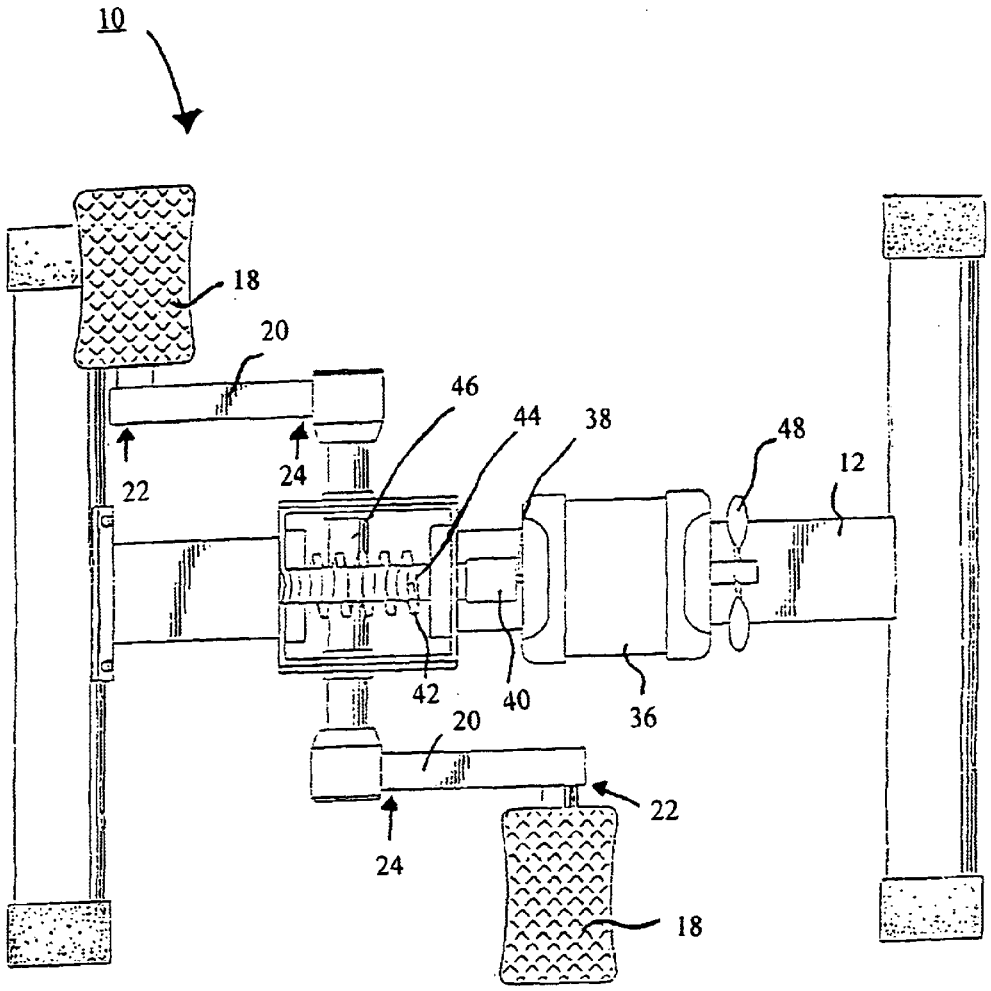
FIG. 5 is a top view of the lower portion of the motorized stationary bike of the present invention, with the transmission case removed to show the moving components of the motorized stationary bike.

As best seen in FIGS. 3 through 5, the motorized stationary bike 10 has a motor 36, a drive shaft 38, a coupler 40, a worm gear 42, and a toothed gear 44. The motor 36, the drive shaft 38, the coupler 40, and the worm gear 42 are axially aligned one to another, and are horizontally disposed on the bike frame 12.

Referring particularly to FIGS. 4 and 5, the motor 36 is connected to the drive shaft 38, and the drive shaft 38 is coupled to the worm gear 42 by coupler 40. The worm gear 42 is engaged to the toothed gear 44 which has a centrally disposed shaft 46. The shaft 46 horizontally and outwardly extends at both sides of the toothed gear 44. The second end 24 of each of the step pedal supporting arms 20 is connected to the shaft 46, in the region of each of the sides of the toothed gear 46, such that each of the step pedal supporting arms 20 extends in an opposed direction one to the other. The first end 22 of each of the step pedal supporting arms 20 has a step pedal 18 pivotally attached thereto.

Still further, the first end 30 of the seat supporting arm 28 has the seat 26 attached thereto, and the second end 32 of the seat supporting arm 28 is mounted on the bike frame 12, in the region of the second end 16 of the bike frame 12 thereof.

Generally, the handlebar mounting frame 34 is situated on the bike frame 12, in the region of the first end 14 of the bike frame 12 thereof.

It is important to note that in the motorized stationary bike 10 of the present invention, the toothed gear 44 and the motor 36 each has an axis I and II respectively. The axis I of the toothed gear 44 is located in a plane which is perpendicular to the plane in which the axis II of the motor 36 is located.

The motor 36 is coupled to an electrical energy source such that when the motor 36 is turned on, the worm gear 42 drives the toothed gear 44, which causes each of the step pedal supporting arms 20 and the respective step pedal 18 to turn.

Typically, but not necessarily, the motorized stationary bike 10 of the present invention may further comprise a fan 48. The fan 48 is connected to the motor 36 at an end remote from the drive shaft 38. Primarily, the fan 48 dissipates the heat which is generated by the motor 36 when it is in the on mode.

Figure 6:
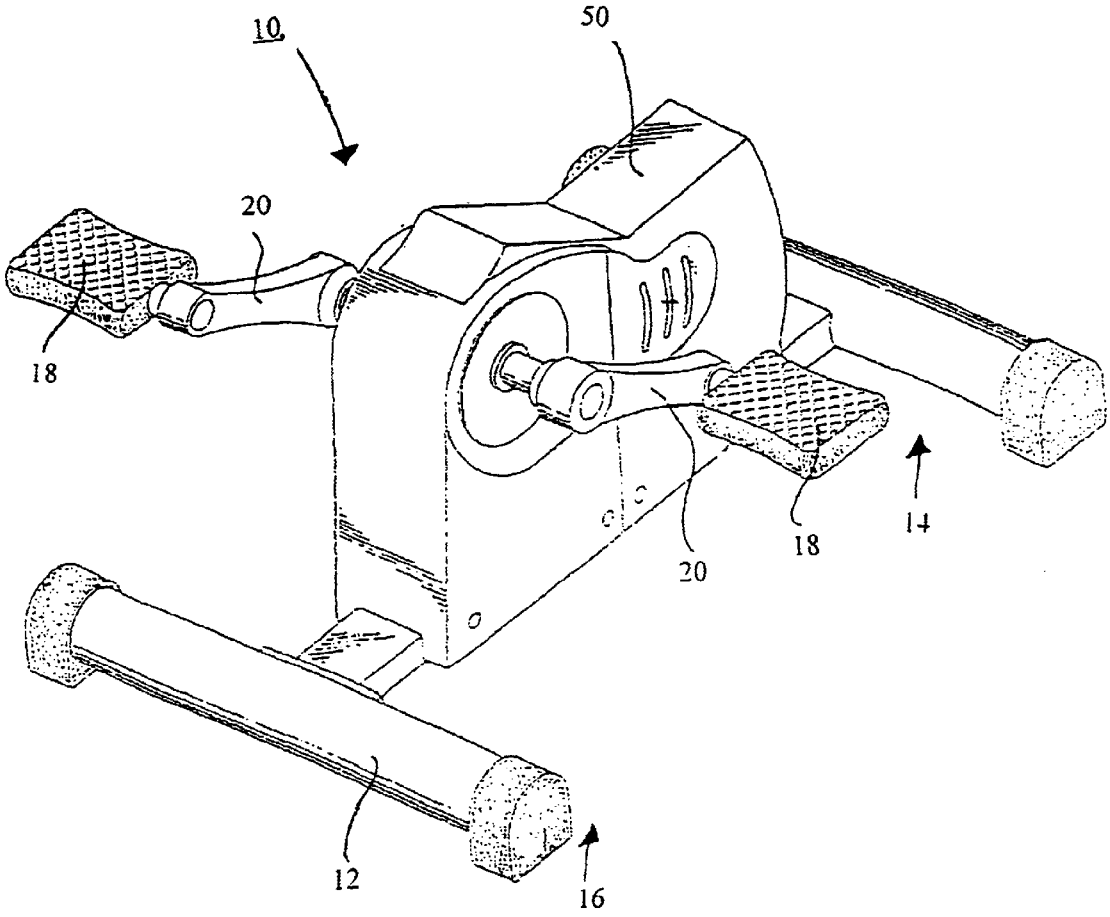
FIG. 6 is a perspective view of the lower portion of the motorized stationary bike of the present invention.

For cosmetic purposes, the motorized stationary bike 10 of the present invention further comprises a transmission case 50. With reference to FIG. 6, the transmission case 50 is mounted on the bike frame 12, in the region between the first and second ends 14 and 16 respectively, of the bike frame 12. The transmission case 50 houses the motor 36, the drive shaft 38, the coupler 40, the worm gear 42, the toothed gear 44, the shaft 46, and the fan 48.

In order to ensure that the person undergoing rehabilitation is comfortably seated with his feet positioned at an appropriate distance from the seat 26, the seat supporting arm 28 may be adjusted. As best seen in FIG. 2, the seat supporting arm 28 has two portions 28*a* and 28*b*. The two portions 28*a* and 28*b* are arranged in such a manner that support arm portion 28*a* is telescopically fitted over support arm portion 28*b* so as to permit the length of the support arm 28 to be adjusted.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

What is claimed is:

1. A motorized stationary bike for lower body rehabilitation, said motorized stationary bike comprising:

a bike frame having first and second ends;

a pair of step pedals;

a pair of step pedal supporting arms, each having first and second ends;

a seat, and a seat supporting arm having first and second ends;

a handlebar mounting frame;

a motor, a drive shaft, a coupler, a worm gear, and a toothed gear;

wherein said motor, said drive shaft, said coupler, and said worm gear are axially aligned one to another, and are horizontally disposed on said bike frame;

wherein said motor is connected to said drive shaft, and wherein said drive shaft is coupled to said worm gear by said coupler;

wherein said worm gear is engaged to said toothed gear;

wherein said toothed gear has a centrally disposed shaft, and wherein said shaft horizontally and outwardly extends at both sides of said toothed gear;

wherein said second end of each of said step pedal supporting arms is connected to said shaft, in the region of each of said sides of said toothed gear, such that each of said step pedal supporting arms extends in an opposed direction one to the other;

wherein said first end of each of said step pedal supporting arms has a step pedal pivotally attached thereto;

wherein said first end of said seat supporting arm has said seat attached thereto, and wherein said second end of said seat supporting arm is mounted on said bike frame, in the region of said second end of said bike frame thereof;

wherein said handlebar mounting frame is situated on said bike frame, in the region of said first end of said bike frame thereof;

wherein said toothed gear and said motor each has an axis, and wherein said axis of said toothed gear is located in a plane which is perpendicular to the plane in which said axis of said motor is located; and wherein said motor is coupled to an electrical energy source such that when said motor is turned on, said worm gear drives said toothed gear, which causes each of said step pedal supporting arms and said respective step pedal to turn.

2. A motorized stationary bike of claim 1, further comprising a fan, and wherein said fan is connected to said motor at an end remote from said drive shaft.

3. A motorized stationary bike of claim 1, further comprising a transmission case, wherein said transmission case is mounted on said bike frame, in the region between said first and second ends of said bike frame, and wherein said transmission case houses said motor, said drive shaft, said coupler, said worm gear, said toothed gear, said shaft and said fan therein.

4. A motorized stationary bike of claim 1, wherein said seat supporting arm has two portions, and wherein said two portions are telescopically fitted one over the other so as to permit the adjustment of said seat on said seat supporting arm.

* * * * *